US009611851B2

(12) United States Patent
Endou

(10) Patent No.: US 9,611,851 B2
(45) Date of Patent: Apr. 4, 2017

(54) CONTROL METHOD OF ELECTRIC COMPRESSOR, CONTROLLER, AND REFRIGERATOR

(71) Applicant: Panasonic Corporation, Kadoma-shi, Osaka (JP)

(72) Inventor: Katsumi Endou, Shiga (JP)

(73) Assignee: PANASONIC CORPORATION, Osaka (JP)

( * ) Notice: Subject to any disclaimer, the term of this patent is extended or adjusted under 35 U.S.C. 154(b) by 398 days.

(21) Appl. No.: 14/126,298

(22) PCT Filed: Mar. 1, 2013

(86) PCT No.: PCT/JP2013/001282
§ 371 (c)(1),
(2) Date: Dec. 13, 2013

(87) PCT Pub. No.: WO2013/128946
PCT Pub. Date: Sep. 6, 2013

(65) Prior Publication Data

US 2014/0105754 A1 Apr. 17, 2014

(30) Foreign Application Priority Data

Mar. 2, 2012 (JP) ..... 2012-046199
Jan. 10, 2013 (JP) ..... 2013-002273

(51) Int. Cl.
*F04C 28/08* (2006.01)
*F04B 35/04* (2006.01)
*F04B 49/06* (2006.01)

(52) U.S. Cl.
CPC ..... *F04C 28/08* (2013.01); *F04B 35/04* (2013.01); *F04B 49/06* (2013.01); *F04B 2203/0209* (2013.01)

(58) Field of Classification Search
None
See application file for complete search history.

(56) References Cited

U.S. PATENT DOCUMENTS 4,734,628 A * 3/1988 Bench ..... F04B 49/065 318/599
2001/0001227 A1* 5/2001 Notohara ..... H02M 5/4585 318/268

(Continued)

FOREIGN PATENT DOCUMENTS

CN 1200847 12/1998
CN 1778032 5/2006

(Continued)

OTHER PUBLICATIONS

Chinese Office Action, May 26, 2005; Chinese Patent Application No. 201380006512.2, with English translation (11 pages).

*Primary Examiner* — Devon Kramer
*Assistant Examiner* — Kenneth J Hansen
(74) *Attorney, Agent, or Firm* — Hamre, Schumann, Mueller & Larson, P.C.

(57) ABSTRACT

A control device for an electric compressor for use in a refrigeration cycle includes an inverter circuit and controller for outputting a driving signal to a DC motor. The controller is configured to set a specified constant rotating speed as a target rotating speed (Rt) of the DC motor (103) (SI), obtain an actual measurement rotating speed (Rm) which is a measurement value of a rotating speed of the DC motor (103) (S2), adjust a duty ratio of driving electric power of the DC motor (103) so that the actual measurement rotating speed (Rm) matches the target rotating speed (Rt) (S3), and newly set the target rotating speed based on a change in the duty ratio (S4).

5 Claims, 7 Drawing Sheets

(56) References Cited

U.S. PATENT DOCUMENTS

| | | | | |
|---|---|---|---|---|
| 2006/0082339 | A1* | 4/2006 | Hamaoka ..... | F04B 35/04<br>318/400.21 |
| 2006/0179859 | A1 | 8/2006 | Nakata et al. | |
| 2007/0052382 | A1 | 3/2007 | Nomura et al. | |

FOREIGN PATENT DOCUMENTS

| | | |
|---|---|---|
| CN | 1788411 | 6/2006 |
| JP | 56-37441 | 4/1981 |
| JP | 62-9165 | 1/1987 |
| JP | H09-88837 | 3/1997 |
| JP | 2001-268967 | 9/2001 |
| JP | 2002-027777 | 1/2002 |
| JP | 2008-101531 | 5/2008 |
| JP | 2008-283769 | 11/2008 |

* cited by examiner

CONTROL METHOD OF ELECTRIC COMPRESSOR, CONTROLLER, AND REFRIGERATOR

TECHNICAL FIELD

The present invention relates to an electric compressor included in a refrigeration cycle. Particularly, the present invention relates to a control method of an electric compressor including a DC motor and being PWM-controlled, a control device (controller) of the electric compressor, and a refrigerator incorporating this control device.

BACKGROUND ART

Conventionally, there is an electric compressor incorporating a DC motor, as an electric compressor included in a refrigeration cycle of a refrigerator. This electric compressor operates to circulate a refrigerant according to an internal temperature to keep food stored in the refrigerator at an appropriate temperature. Also, in recent years, there is known a technique in which a DC motor of an electric compressor is PWM-controlled, thereby achieving energy saving (e.g., see Patent Literature 1).

Patent Literature 1 discloses a running control device of the refrigerator, including a set temperature detecting means which detects a set temperature, an internal temperature detecting means which detects an internal temperature of the refrigerator, and an outside air temperature detecting means which detects a temperature of an outside region of the refrigerator. This control device sets an operational rotating speed of the electric compressor in multiple stages according to a difference between the internal temperature and the set temperature. Patent Literature 1 discloses that the control device sets the rotating speed as follows: when the temperature difference is equal to or greater than 5 degrees C., the rotating speed is 5400 rpm, when the temperature difference is in a range of 5 to 2 degrees C., the rotating speed is 3600 rpm, when the temperature difference is in a range of −2 to 2 degrees C., the rotating speed is 1800 rpm, and when the temperature difference is equal to or less than −2 degrees C., the rotating speed is 0. Patent Literature 1 also discloses that the control device changes a minimum rotating speed of the electric compressor based on the outside air temperature detected by the outside air temperature detecting means.

Thus, the control device disclosed in Patent Literature 1 is intended to optimize the set rotating speed of the electric compressor, by obtaining the internal temperature and the outside air temperature. That is, a magnitude of the difference between the internal temperature and the set temperature, and whether the outside air temperature is high or low, correlate with a magnitude of a load (cooling load) of the electric compressor. Therefore, if a detailed change status of the internal temperature and the outside air temperature are obtained, it becomes possible to decide appropriate rotating speeds which can make the internal temperature closer to the set temperature while considering a magnitude of the cooling load.

CITATION LIST

Patent Literature

Patent Literature 1: Japanese Laid-Open Patent Application Publication No. Sho. 62-9165

SUMMARY OF INVENTION

Technical Problem

However, the control method disclosed in Patent Literature 1 is implemented by providing the internal temperature detecting means and the outside air temperature detecting means, and by detecting a detailed change status (at least plural temperatures) by the internal temperature detecting means. In other words, the control method disclosed in Patent Literature 1 cannot be implemented unless all of these conditions are satisfied. For example, in a case where a refrigerator which does not include the outside air temperature detecting means, or the internal temperature detecting means is capable of detecting only one temperature like a thermostat, the control method disclosed in Patent Literature 1 which takes into account the load of the electric compressor, cannot be implemented.

However, the refrigerator including the two temperature detecting means, which are the internal temperature detecting means and the outside air temperature detecting means, is costly. Also, the internal temperature detecting means disclosed in Patent Literature 1 is capable of detecting plural temperatures, and therefore is more expensive than the thermostat capable of substantially detecting only one temperature. Therefore, the control method disclosed in Patent Literature 1 may be meaningful as a function incorporated into a refrigerator of a certain high-level model but is costly for refrigerators of another levels, which is inappropriate. However, it is desirable to achieve energy saving in a refrigerator including only a thermostat as the internal temperature detecting means.

The present invention is directed to solving the above mentioned problems, and an object of the present invention is to provide a control method, a control device (controller) of an electric compressor, and a refrigerator including the control device, which are capable of setting rotating speeds of an electric compressor based on a cooling load without depending on a detailed change status of an internal temperature and an outside air temperature, while suppressing an increase in cost.

Solution to Problem

To achieve the above described object, there is provided a method of controlling an electric compressor included in a refrigeration cycle and including a DC motor, comprising the steps of: setting a specified constant rotating speed as a target rotating speed of the DC motor; obtaining an actual measurement rotating speed which is a measurement value of a rotating speed of the DC motor; adjusting a duty ratio of driving electric power of the DC motor so that the actual measurement rotating speed matches (reaches) the target rotating speed; and newly setting the target rotating speed based on a change in the duty ratio.

The present inventors found out a correlation between a change in the duty ratio of driving electric power of the DC motor and a change in the cooling load of the electric compressor, when the DC motor of the electric compressor is maintained at a constant target rotating speed. Therefore, by setting the target rotating speed of the DC motor based on the duty ratio, the DC motor can be run at an appropriate rotating speed without depending on a detailed change status of an internal temperature of a refrigerator and an outside air temperature. As a result, the interior of the refrigerator can be cooled appropriately and energy saving can be achieved while suppressing an increase in cost.

Advantageous Effects of Invention

A running method of an electric compressor of the present invention can appropriately cool an interior of a refrigerator and achieve energy saving while suppressing an increase in cost.

DESCRIPTION OF EMBODIMENTS

Figure 1:
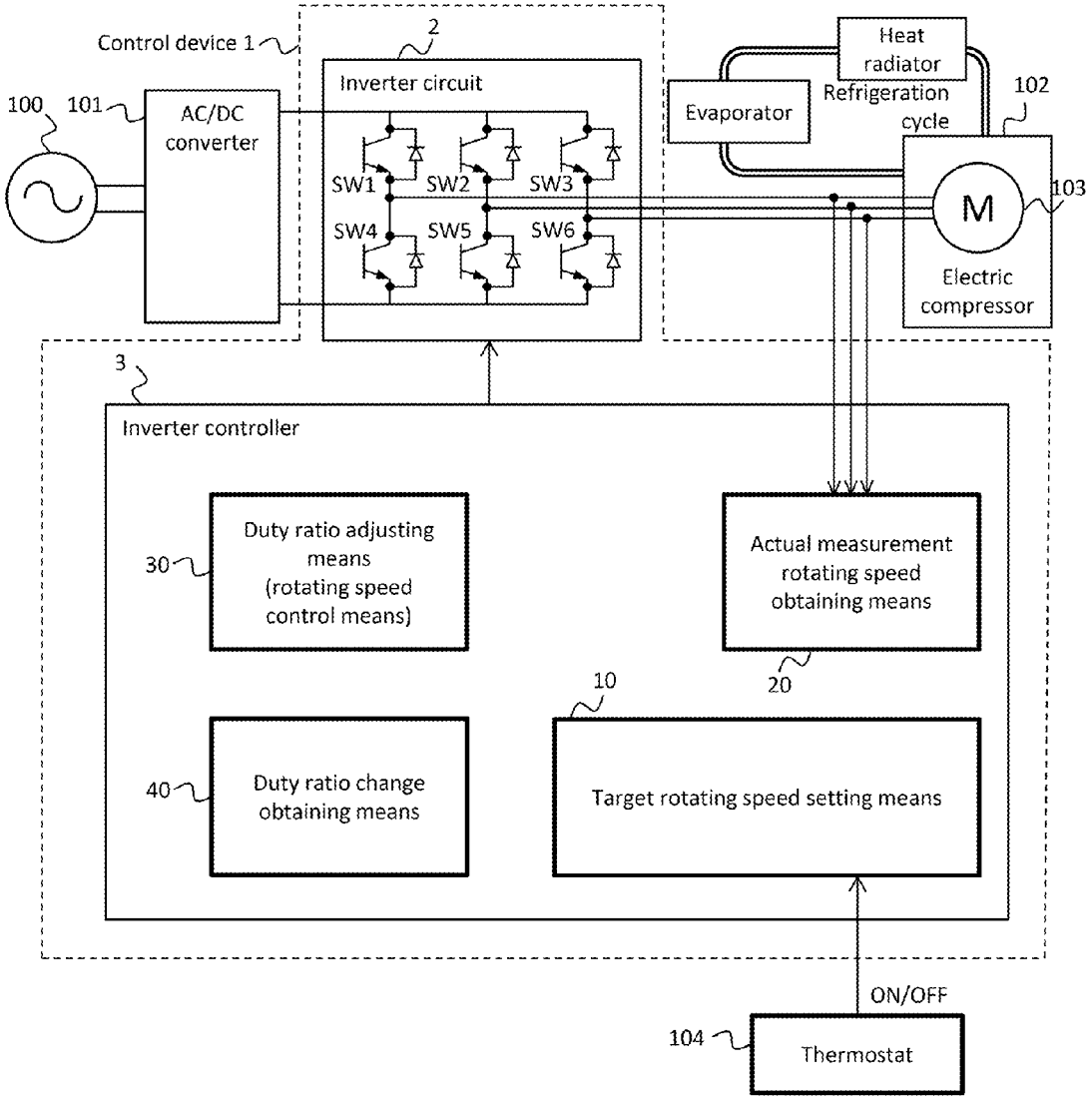
FIG. 1 is a block diagram showing a configuration of a control device (controller) in an electric compressor according to Embodiment 1 of the present invention.

According to a first aspect of the present invention, there is provided a method of controlling an electric compressor included in a refrigeration cycle and including a DC motor, comprising the steps of: setting a specified constant rotating speed as a target rotating speed of the DC motor; obtaining an actual measurement rotating speed which is a measurement value of a rotating speed of the DC motor; adjusting a duty ratio of driving electric power of the DC motor so that the actual measurement rotating speed matches (reaches) the target rotating speed; and newly setting the target rotating speed based on a change in the duty ratio.

According to a second aspect of the present invention, there is provided a control device (controller) of an electric compressor comprising: an inverter circuit for outputting driving electric power to a DC motor of an electric compressor included in a refrigeration cycle; and an inverter controller for outputting a driving signal of the inverter circuit; wherein the inverter controller includes: a target rotating speed setting means which sets a specified constant rotating speed as a target rotating speed of the DC motor; an actual measurement rotating speed obtaining means which obtains an actual measurement rotating speed which is a measurement value of a rotating speed of the DC motor, with a passage of time; a duty ratio adjusting means which adjusts a duty ratio of driving electric power output from the inverter circuit so that the actual measurement rotating speed matches the target rotating speed; and a duty ratio change obtaining means which obtains a change in the duty ratio which occurs with a passage of time; wherein the target rotating speed setting means is configured to newly set the target rotating speed of the DC motor, based on the change in the duty ratio which occurs with a passage of time.

According to a third aspect of the present invention, in the control device of the electric compressor according to the second aspect, the duty ratio change obtaining means may obtain a difference value between the duty ratios set at different timings by the duty ratio adjusting means; and the target rotating speed setting means may increase the target rotating speed based on the difference value between the duty ratios which is obtained by the duty ratio change obtaining means.

According to a fourth aspect of the present invention, in the control device of the electric compressor according to the third aspect, the duty ratio change obtaining means may include: a duty ratio storage means which stores a first duty ratio obtained from the duty ratio adjusting means at a first timing; a time measuring means which measures time that passes from the first timing; and a duty ratio comparator means which compares a second duty ratio obtained from the duty ratio adjusting means at a second timing which is a specified time after the first timing, to the first duty ratio stored in the duty ratio storage means.

According to a fifth aspect of the present invention, in the control device of the electric compressor according to the fourth aspect, the inverter controller may further includes a commutation frequency setting means which sets a commutation frequency of the driving electric power based on the actual measurement rotating speed; and a driving signal synthesizing means which synthesizes the duty ratio set by the duty ratio adjusting means and the commutation frequency set by the commutation frequency setting means, to generate the driving signals.

According to a sixth aspect of the present invention, in the control device of the electric compressor according to any one of the second to fifth aspects, the inverter controller may further include: a switching time setting means which sets time that passes before the target rotating speed is newly set, based on the duty ratio and a voltage input to the inverter circuit.

According to a seventh aspect of the present invention, a refrigerator comprises the control device according to any one of the second to sixth aspects; and an electric compressor including a DC motor and included in a refrigeration cycle.

According to an eighth aspect of the present invention, the refrigerator according to the seventh aspect may further comprise a thermostat which outputs a signal used to determine whether or not an internal temperature of the refrigerator is equal to or higher than a specified temperature; and the control device may newly set the target rotating speed of the DC motor, based on a change in the duty ratio of the driving electric power, which occurs with a passage of time, when the internal temperature is equal to or higher than the specified temperature.

Hereinafter, embodiments of the present invention will be described with reference to the drawings. The present invention is not limited by recitation of the present embodiment.

Embodiment 1

FIG. 1 is a block diagram showing a configuration of a control device (controller) in an electric compressor according to Embodiment 1 of the present invention. As shown in FIG. 1, this control device 1 is interposed between an AC/DC converter 101 connected to a power supply utility 100, and an electric compressor 102 included in a refrigeration cycle of a refrigerator. The AC/DC converter 101 converts AC power supplied from the power supply utility 100 into DC power and outputs the DC power. The electric compressor 102 includes an electric component and a compression component which suctions and discharges a refrigerant by the electric component. As the electric component, a DC motor 103 is used. In the present embodiment, as the DC motor 103, a brushless DC motor having three phases (U-phase, V-phase, W-phase) is used.

The control device 1 includes an inverter circuit 2 and an inverter controller 3. The inverter circuit 2 is configured such that six switching elements (e.g., IGBT; insulated bipolar transistor, etc.) SW1 to SW6 are three-phase-bridge connected. Then, the DC power input from the AC/DC converter 101 to the inverter circuit 2 is selectively output to each of the phases of a stator as driving electric power for driving the DC motor 103.

The inverter controller 3 is constituted by a processor such as MPU, and controls switching of ON/OFF of the switching elements SW1 to SW6 in the inverter circuit 2. In particular, the inverter controller 3 generates driving signals from a commutation frequency for switching a current-applying phase of the stator of the DC motor 103 and a duty ratio of a PWM signal corresponding to a running load of the DC motor 103, and outputs the driving signals to the inverter circuit 2.

In more detail, the inverter controller 3 includes a target rotating speed setting means 10, an actual measurement rotating speed obtaining means 20, a duty ratio adjusting means (rotating speed control means) 30, and a duty ratio change obtaining means 40.

In a case where an internal temperature of a refrigerator is high and the electric compressor 102 should be run (operated), the target rotating speed setting means 10 suitably sets a target rotating speed Rt of the DC motor 103. In the present embodiment, the refrigerator incorporating the control device 1 is equipped with a thermostat 104 for detecting the internal temperature. The thermostat 104 outputs an ON signal when the internal temperature is equal to or higher than a predetermined threshold Th, and outputs an OFF signal when the internal temperature is lower than the threshold Th. Therefore, the target rotating speed setting means 10 obtains the signal from the thermostat. If the target rotating speed setting means 10 obtains the ON signal, the internal temperature is equal to or higher than the threshold Th. Therefore, the target rotating speed setting means 10 determines that "the electric compressor 102 should be run." On the other hand, if the target rotating speed setting means 10 obtains the OFF signal, the internal temperature is lower than the threshold Th. Therefore, the target rotating speed setting means 10 determines that "the electric compressor 102 should be stopped (deactivated)." The threshold Th in the thermostat 104 is a set temperature in an interior of the refrigerator, and may be changed and set by the user's manipulation.

The actual measurement rotating speed obtaining means 20 obtains an actual measurement rotating speed Rm which is a measurement value of the rotating speed of the DC motor 103 with a passage of time. For example, the actual measurement rotating speed obtaining means 20 obtains a position detection signal indicating that a rotor is in a specified position from a reverse voltage of the DC motor 103, at specified sampling periods. The actual measurement rotating speed obtaining means 20 calculates the actual measurement rotating speed of the DC motor 103 by counting the position detection signal during a specified period.

The duty ratio adjusting means 30 adjusts a duty ratio of the driving electric power output from the inverter circuit 2 so that the actual measurement rotating speed Rm of the DC motor 103 matches the target rotating speed Rt of the DC motor 103. This will be described more specifically. In a case where the DC motor 103 is operated so that its rotating speed matches the target rotating speed Rt (Rm=Rt), a timing (commutation frequency) when the current-applying phase of the stator is switched is determined based on a rotating speed (actual measurement rotating speed Rm) at a present time point of the DC motor 103. However, even in a case where the DC motor 103 is operated at a constant rotating speed (constant commutation frequency), easiness of the rotation of the DC motor 103 is varied depending on the cooling load. For this reason, it is required that a value of a voltage applied to the current-applying phase be a magnitude corresponding to the cooling load. Accordingly, a voltage value of the electric power supplied to the current-applying phase is pulse-width modulated (PWM), and the duty ratio which is a ratio of the ON-time to a carrier cycle is adjusted based on the cooling load.

The cooling load directly depends on the internal temperature or the outside air temperature. Especially, the internal temperature decreases as the operation time of the electric compressor 102 passes, and correspondingly, the cooling loading decreases. Because of this, if an attempt is made to maintain the rotating speed of the DC motor 103 at a constant value, it is necessary to decrease the duty ratio according to the decrease in the cooling load (i.e., decrease in the internal temperature). Thus, the duty ratio adjusting means 30 adjusts the duty ratio of the driving electric power according to the cooling load during execution of operation control so that the rotating speed (actual measurement rotating speed Rm) of the DC motor 103 matches the target rotating speed Rt of the DC motor 103. More specifically, if the commutation frequency and the duty ratio are kept constant, the actual measurement rotating speed Rm of the DC motor 103 changes with a change in the cooling load. Therefore, the duty ratio adjusting means 30 adjusts the duty ratio so that the change in the actual measurement rotating speed Rm falls within a predetermined range ΔR, thereby attaining a state in which the actual measurement rotating speed Rm substantially matches the target rotating speed Rt.

The duty ratio change obtaining means 40 obtains the duty ratio adjusted and set by the duty ratio adjusting means 30, with a passage of time, thus obtaining a change in the duty ratio with a passage of time. For example, in a case where the DC motor 103 is run (operated) at a constant rotating speed (constant commutation frequency), the duty ratio change obtaining means 40 obtains a change amount of the duty ratio before and after a specified time period passes. This makes it possible to know how the cooling load has changed with a passage of the specified time period.

[Control Method]

Figure 2:
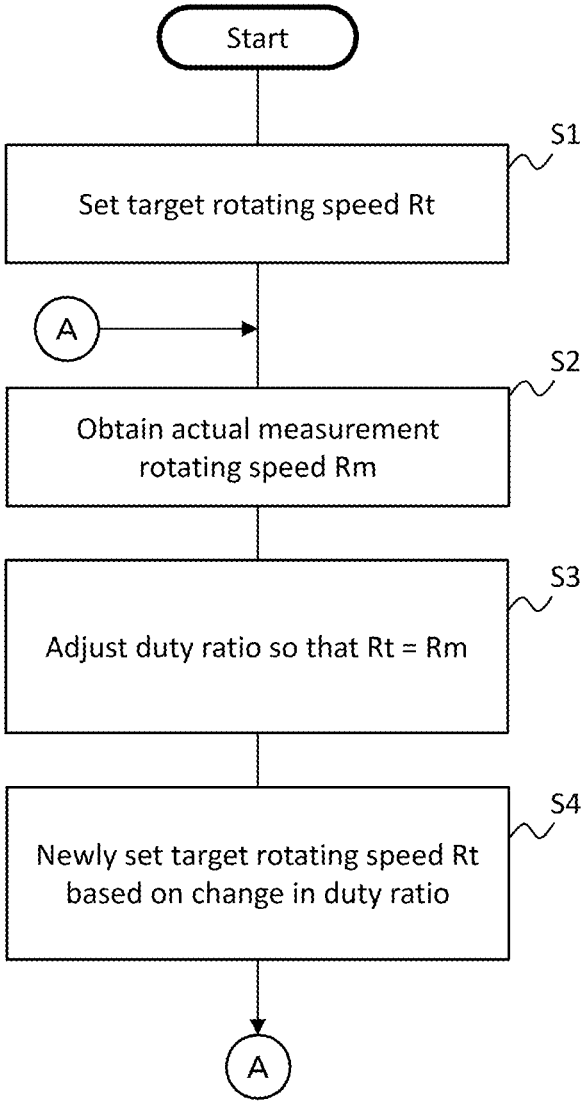
FIG. 2 is a flowchart showing an operation procedure of the control device according to Embodiment 1.

Next, a control method of the electric compressor 102 which is implemented by the above stated control device 1 will be described. FIG. 2 is a flowchart showing an operation procedure of the control device 1 according to Embodiment 1.

As shown in FIG. 2, the target rotating speed setting means 10 of the control device 1 sets the target rotating speed Rt of the DC motor 103 to a specified value (step S1). The actual measurement rotating speed obtaining means 20 obtains the actual measurement rotating speed Rt of the DC motor 103 with a passage of time (step S2). Then, the duty ratio adjusting means 30 adjusts the duty ratio based on a change (change in cooling load) in a difference value between the target rotating speed Rt set in step S1 and the actual measurement rotating speed Rm obtained with a passage of time in step S2 (step S3). Furthermore, the target rotating speed setting means 10 suitably newly sets the target rotating speed Rt based on the change in the duty ratio which occurs with a passage of time (step S4).

The duty ratio change obtaining means 40 obtains the "change in the duty ratio" in step S4, based on the duty ratio set by the duty ratio adjusting means 30, and inputs this "change in the duty ratio" to the target rotating speed setting means 10. In step S4, the target rotating speed Rt may be newly set by, for example, a method described below. That is, in a case where the difference value in the duty ratio before and after a passage of the specified time period is relatively great (i.e., change in the duty ratio is great), it may be determined that cooling has progressed to a certain degree but the target temperature has not been reached yet. In this case, therefore, the electric compressor 102 is controlled in such a manner that the target rotating speed Rt is updated from the present value to a value which is a little greater than the present value so that the target temperature can be reached more quickly. On the other hand, in a case where the difference value in the duty ratio before and after a passage of the specified time period is relatively small (i.e., change in the duty ratio is small), it may be determined that cooling has not progressed as desired. In this case, therefore, the electric compressor 102 is controlled in such a manner that the target rotating speed Rt is updated from the present value to a value which is much greater than the present value, to promote lowering of the internal temperature.

Alternatively, the difference value in the duty ratio may be newly set in stages (equal to or more than 3 stages) more than those of the above case, and different target rotating speeds Rt may be newly set according to these stages. This makes it possible to run the electric compressor 102 at a more appropriate rotating speed according to a present cooling load, without a need to change a specification of hardware.

In step S4 and the following steps, based on the updated target rotating speed Rt, step S2 and the following steps are performed. It should be noted that if the internal temperature has been lowered adequately to a value lower than the threshold Th, in the middle of step S1 to step S4, the thermostat 104 switches the output signal from the ON-signal to the OFF-signal. Receiving the OFF signal from the thermostat 104, the target rotating speed setting means 10 sets the target rotating speed Rt to zero. As a result, the DC motor 103 is controlled so that its rotating speed becomes zero, and is finally stopped.

In accordance with the control device 1 and its operation as described above, without detecting the detailed internal temperatures and the outside air temperature, energy saving can be achieved by performing running of the electric compressor according to the load while suppressing an increase in cost. That is, the control device 1 according to the present embodiment reads the cooling load based on the change in the duty ratio during a period when the rotating speed of the DC motor 103 is maintained at a constant value. Therefore, without providing the internal temperature detecting means and the outside air temperature detecting means which are costly, the target rotating speed Rt of the DC motor 103 can be set appropriately based on the change in the duty ratio.

Embodiment 2

Figure 3:
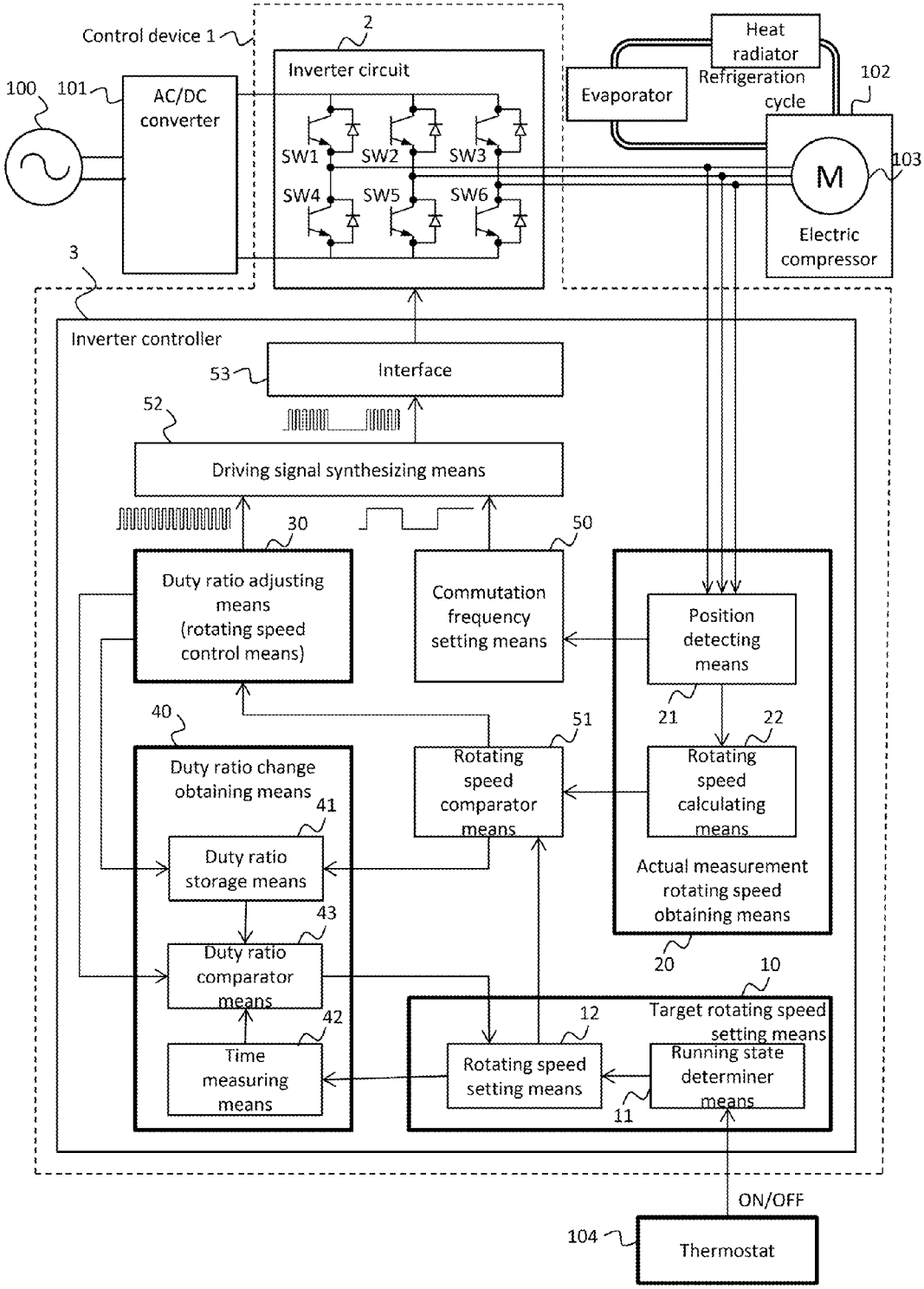
FIG. 3 is a block diagram showing a configuration of a control device in an electric compressor according to Embodiment 2 of the present invention.

In Embodiment 2, a description will be given of a more specific application example of the control device of the electric compressor and the control method thereof according to Embodiment 1, as described above. FIG. 3 is a block diagram showing a configuration of a control device in an electric compressor according to Embodiment 2. As in the case of Embodiment 1, the control device 1 of Embodiment 2 is interposed between the AC/DC converter 101 connected to the power supply utility 100, and the electric compressor 102 included in the refrigeration cycle of the refrigerator. The control device 1 includes the inverter circuit 2, and the inverter controller 3 including the target rotating speed setting means 10, the actual measurement rotating speed obtaining means 20, the duty ratio adjusting means 30, and the duty ratio change obtaining means 40.

The target rotating speed setting means 10 includes a running state determiner means (compressor running detecting means) 11 and a rotating speed setting means 12. The running state determiner means 11 receives a signal from the thermostat 104 and determines a target running state of the electric compressor 102 based on the received signal. For example, when the running state determiner means 11 receives the ON-signal (internal temperature≥Th) from the thermostat 104, the running state determiner means 11 determines that the electric compressor 102 should be run. On the other hand, when the running state determiner means 11 receives the OFF-signal (internal temperature<Th) from the thermostat 104, the running state determiner means 11 determines that the electric compressor 102 should be stopped (deactivated).

When the electric compressor 102 should be run, the rotating speed setting means 12 sets the corresponding target rotating speed Rt to a predetermined value greater than zero. As the predetermined value, a running rotating speed which can achieve a highest efficiency in terms of a fuel efficiency, a minimum rotating speed with which the electric compressor 102 can operate stably, etc., which rotating speeds are decided based on a specification of the electric compressor 102, may be used. As will be described later, the rotating speed setting means 12 newly sets the target rotating speed Rt, based on the change in the duty ratio. On the other hand, when the electric compressor 102 should be stopped, the rotating speed setting means 12 sets the corresponding target rotating speed Rt to zero.

The actual measurement rotating speed obtaining means 20 includes a position detecting means 21 and a rotating speed calculating means 22. The position detecting means 21 obtains a position detection signal indicating that a rotor is in a specified position from a reverse voltage of the DC motor 103, at specified sampling periods. The rotating speed calculating means 22 calculates the actual measurement rotating speed Rm of the DC motor 103, by, for example, counting this position detection signal during a specified period.

The inverter controller 3 includes a commutation frequency setting means 50. The commutation frequency setting means 50 obtains the above stated position detection signal from the position detecting means 21. Using this position detection signal, the commutation frequency setting means 50 generates a commutation pulse signal which defines a switching frequency (commutation frequency) of the current-applying phase of the stator.

The inverter controller 3 includes a rotating speed comparator means 51. The rotating speed comparator means 51 receives as inputs the target rotating speed Rt set by the rotating speed setting means 12 and the actual measurement rotating speed Rm calculated by the rotating speed calculating means 22. The rotating speed comparator means 51 obtains a difference value (=Rm−Rt) between the target rotating speed Rt and the actual measurement rotating speed Rm, and outputs the difference value to the duty ratio adjusting means 30.

When the actual measurement rotating speed Rm is lower than the target rotating speed Rt (Rm−Rt<0), this means that the output from the rotating speed comparator means 51 to the duty ratio adjusting means 30 is a command for increasing the duty ratio. On the other hand, when the actual measurement rotating speed Rm is higher than the target rotating speed Rt (Rm−Rt>0), this means that the output from the rotating speed comparator means 51 to the duty ratio adjusting means 30 is a command for decreasing the duty ratio. Therefore, the duty ratio adjusting means 30 adjusts (increase, decrease or maintain) and sets the duty ratio based on the input from the rotating speed comparator means 51. When the duty ratio adjusting means 30 increases the duty ratio, the voltage of the driving electric power applied to the DC motor 103 increases, while when the duty ratio adjusting means 30 decreases the duty ratio, the voltage of the driving electric power applied to the DC motor 103 decreases.

The inverter controller 3 further includes a driving signal synthesizing means 52 and an interface 53. The driving signal synthesizing means 52 synthesizes a commutation pulse signal having the commutation frequency set by the commutation frequency setting mean 50 and a PWM signal having the duty ratio set by the duty ratio adjusting means 30 to generate driving signals for driving the switching elements SW1 to SW6 of the inverter circuit 2. This driving signals are output to the inverter circuit 2 via the interface 53 including a photo coupler, or the like. Based on this driving signals, the inverter circuit 2 operates. As a result, the driving electric power supplied from the AC/DC converter 101 to the DC motor 103 is distributed to each phase in the DC motor 103 in a cycle defined by the commutation frequency and its voltage waveform has the above stated duty ratio.

The duty ratio change obtaining means 40 includes a duty ratio storage means 41, a time measuring means 42 and a duty ratio comparator means 43. The duty ratio storage means 41 stores a duty ratio D1 at that point of time which is set by the duty ratio adjusting means 30, at a specified timing. In the present embodiment, the specified timing is a time point when the actual measurement rotating speed Rm matches the target rotating speed Rt. Therefore, the duty ratio storage means 41 receives information indicating the difference value between the actual measurement rotating speed Rm and the target rotating speed Rt, from the rotating speed comparator means 51. The phrase "the actual measurement rotating speed Rm matches the target rotating speed Rt" does not mean that the actual measurement rotating speed Rm perfectly matches the target rotating speed Rt, but may be defined as a case where the actual measurement rotating speed Rm lies within a specified range (e.g., range ΔR of the rotating speed described in Embodiment 1) including the target rotating speed Rt.

The time measuring means 42 measures time which passes after a reference time point when the target running state determined by the running state determiner means 11 has switched from "stop" to "run", or the target rotating speed Rt has changed from zero to another value. In the present embodiment, the reference time point is the time point when the target rotating speed Rt has changed from zero to another value. To this end, the rotating speed setting means 12 outputs the signal indicating the target rotating speed Rt to the time measuring means 42. The time measuring means 42 detects as the reference time point, the time point when the target rotating speed Rt has changed from zero to another value.

When the time received from the time measuring means 42 has reached a specified time, the duty ratio comparator means 43 obtains a duty ratio D2 at that point of time, from the duty ratio adjusting means 30 In addition, the duty ratio comparator means 43 obtains the duty ratio D1 stored in the duty ratio storage means 41. Then, the duty ratio comparator means 43 calculates a difference value between the duty ratio D1 and the duty ratio D2 and outputs the difference value to the rotating speed setting means 12. The rotating speed setting means 12 newly sets the target rotating speed Rt based on the difference value.

[Control Method]

Figure 4:
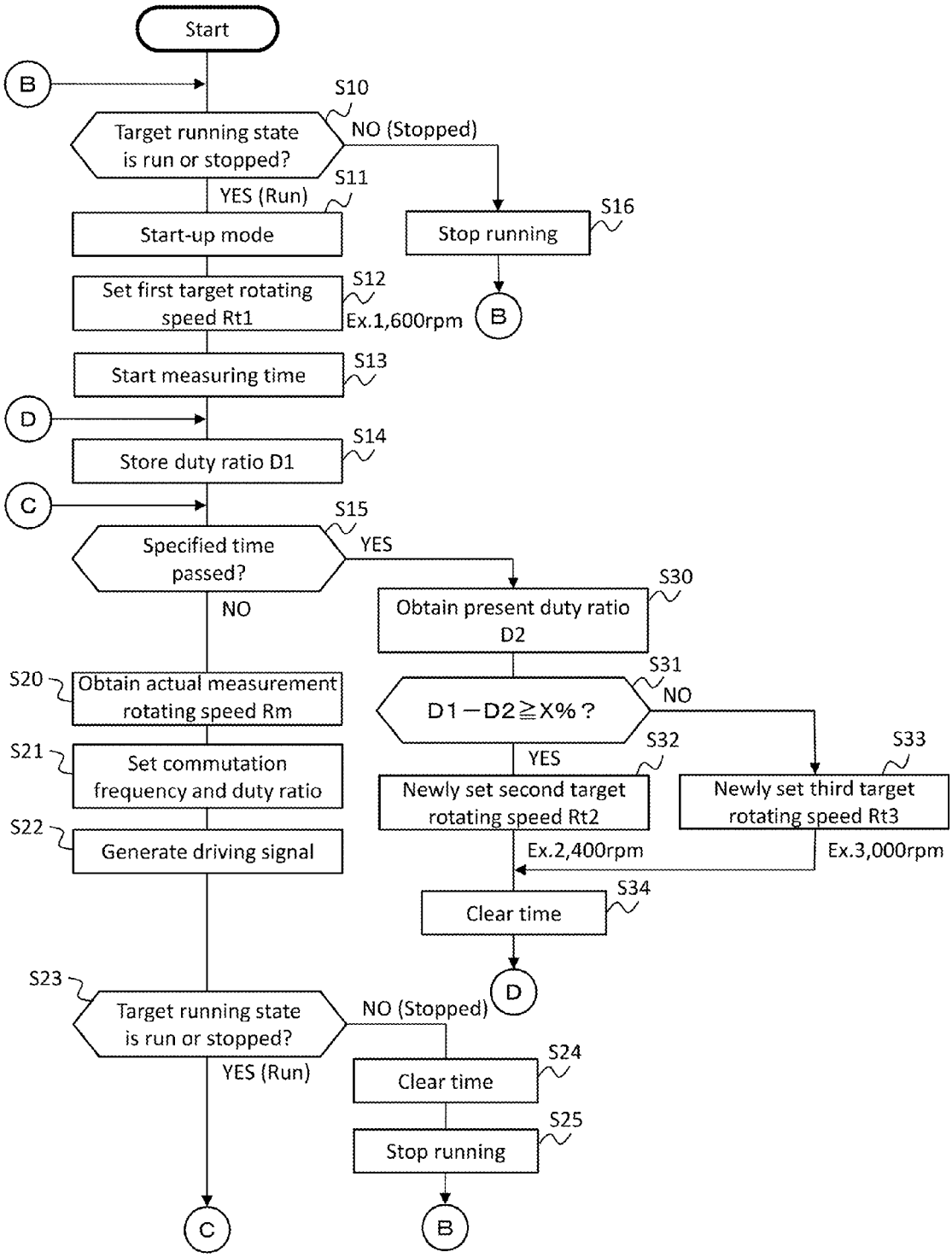
FIG. 4 is a flowchart showing an operation procedure of the control device according to Embodiment 2.

Next, a description will be given of the control method of the electric compressor 102 which is implemented by the above stated control device 1. FIG. 4 is a flowchart showing an operation procedure of the control device 1 according to Embodiment 2.

As shown in FIG. 4, the running state determiner means 11 of the control device 1 determines whether the target running state of the electric compressor 102 is "the electric compressor 102 should be run" or "the electric compressor 102 should be stopped" based on the signal received from the thermostat 104 (step S10). When the running state determiner means 11 determines that "the electric compressor 102 should be stopped" (S10: NO), it performs predetermined processing (including processing for maintaining a stopped state) for stopping the electric compressor 102 (step S16), and re-performs processing in step S10. On the other hand, when the running state determiner means 11 determines that the "electric compressor 102 should be run" (S10: YES), it operates the electric compressor 102 in a predetermined start-up (activation) mode (step S11).

This start-up mode is a predetermined operation sequence for starting-up (activating) the electric compressor 102 in a stopped state (deactivated state). When the electric compressor 102 is in the stopped state, the position detecting means 21 cannot detect the reverse voltage of the DC motor 103, and therefore cannot detect the position of the rotor. In addition, as a matter of course, the change in the duty ratio which is an indicator of the cooling load, cannot be detected. Therefore, in the start-up mode, irrespective of the position of the rotor and the cooling load, predetermined initial values are used as the commutation frequency and the duty ratio to generate the driving signals, to start-up the DC motor 103. Then, at a time point when a predetermined condition is satisfied, the start-up mode is terminated. This predetermined condition is at least required to be such that the position detecting means 21 can obtain the position detection signal and the driving signals can be generated from the commutation frequency and the duty ratio.

When the start-up mode is terminated, the target rotating speed setting means 10 sets a first target rotating speed Rt1 (e.g., 1,600 rpm) (step S12). As described above, as the first target rotating speed Rt1, a rotating speed which is determined based on a specification of the electric compressor 102 and can achieve a highest efficiency in terms of a fuel efficiency, may be used. At the same time, the time measuring means 42 starts measuring time (step S13), and the duty ratio storage means 41 stores the duty ratio D1 at that point of time (step S14). Then, it is determined whether or not a specified time period (e.g., 5 minutes, 10 minutes, or other time) has passed after the time measuring means 42 has started measuring time (step S15). If it is determined that the specified time period has not passed, the processing (step S20 and the following steps) for generating the driving signals by mainly adjusting the duty ratio while maintaining a present target rotating speed, is performed. On the other hand, if it is determined that the specified time period has passed, the processing (step S30 and the following steps) for newly setting the target rotating speed according to the cooling load is performed.

Now, step S20 and the following steps will be described. Initially, the actual measurement rotating speed obtaining means 20 generates the position detection signal based on the reverse voltage of the DC motor 103 and obtains the actual measurement rotating speed Rm based on this position detection signal (step S20). The position detection signal is output to the commutation frequency setting means 50, while the signal indicating the actual measurement rotating speed Rm is output to the rotating speed comparator means 51. Then, the commutation frequency setting means 50 sets the commutation frequency using the obtained position detection signal (step S21). The rotating speed comparator means 51 obtains the difference value between the actual measurement rotating speed Rm and the target rotating speed Rt, and outputs the difference value to the duty ratio adjusting means 30. The duty ratio adjusting means 30 adjusts and sets the duty ratio based on the difference value (step S21). That is, when Rm−Rt<0, the duty ratio adjusting means 30 increases the duty ratio, while when Rm−Rt>0, the duty ratio adjusting means 30 decreases the duty ratio.

The commutation frequency and the duty ratio set as described above are input to the driving signal synthesizing means 52. The driving signal synthesizing means 52 generates the driving signals based on the commutation frequency and the duty ratio (step S22). In other words, the driving signal synthesizing means 52 generates the driving signals having an AND of the signal having the above stated commutation frequency and the signal having the above stated duty ratio. This driving signals are output to the inverter circuit 2 via the interface 53 to operate the switching elements SW1 to SW6. As a result, the DC power from the AC/DC converter 101 becomes the driving electric power having the commutation frequency and the duty ratio set in step S21, and is supplied to each current-applying phase of the stator of the DC motor 103. Therefore, the DC motor 103 is controlled so that the actual measurement rotating speed Rm matches the target rotating speed Rt.

After generating the driving signals, the running state determiner means 11 determines a target running state at a present time point (step S23). When the running state determiner means 11 determines that "the electric compressor 102 should be run" (S23: YES), this means that the internal temperature has not been yet lowered to the threshold Th at which thermostat 104 is turned OFF, and therefore step S15 and the following steps are repeated. On the other hand, when the running state determiner means 11 determines that "the electric compressor 102 should be stopped" (S23: NO), this means that the internal temperature has been lowered to the threshold Th. Therefore, the running state determiner means 11 clears the time measured by the time measuring means 42 (step S24) and stops running of the electric compressor 102 (step S25).

After the target rotating speed is set (S12) and the duty ratio is stored (S14), step S20 and the following steps are repeated until the specified time passes. And, the rotating speed of the DC motor 103 is controlled by adjusting the duty ratio while maintaining the target rotating speed set in step S12. During this time, if the actual measurement rotating speed Rm reaches the target rotating speed Rt, the DC motor 103 is stopped in response to the OFF-signal from the thermostat 104 (S25).

Next, a description will be given of step S30 and the following steps in a case where it is determined that the specified time period has passed in step S15. In this case, the duty ratio comparator means 43 obtains a duty ratio D2 at a present time point from the duty ratio adjusting means 30 (step S30). In addition, the duty ratio comparator means 43 obtains the duty ratio D1 stored in the duty ratio storage means 41 in step S15, and determines whether or not a difference value (=D1−D2) between the duty ratio D1 and the duty ratio D2 is equal to or greater than a predetermined value X % (step S31). In other words, in a case where the electric compressor 102 is run for a continued specified time period, the duty ratio comparator means 43 determines a degree of the cooling load based on a degree of a decrease in the duty ratio before and after the specified time period passes.

When the duty ratio comparator means 43 determines that the difference value of the duty ratio is equal to or greater than the predetermined value X % (S31: YES), the target rotating speed Rt is newly set to a second target rotating speed Rt2 (e.g., 2400 rpm) which is a little higher than the target rotating speed Rt (step S32). That is, the fact that the difference value of the duty ratio is equal to or higher than the predetermined value X % means that the internal temperature has been lowered to a relatively great degree as a result of the cooling for the specified time period but has not reached the threshold Th at which the thermostat 104 is turned OFF. Therefore, step S32 is intended to increase the target rotating speed Rt a little to enhance a cooling capability so that the internal temperature can reach the threshold Th more quickly.

On the other hand, when the duty ratio comparator means 43 determines that the difference value of the duty ratio is less than the predetermined value X % (S31: NO), the target rotating speed Rt is newly set to a third target rotating speed Rt3 (e.g., 3,000 rpm) which is much higher than the target rotating speed Rt (step S33). That is, the fact that the difference value of the duty ratio is less than the predetermined value X % means that the internal temperature has not been lowered adequately in spite of the cooling for the specified time period. As an example of such a situation, there is a case where high-temperature food is stored in the refrigerator, and as a result, the internal temperature becomes much higher than the set temperature (threshold Th), which increase the cooling load. Therefore, step S33 is intended to greatly increase the target rotating speed Rt to drastically enhance the cooling capability so that the internal temperature can reach the threshold Th more quickly.

After the target rotating speed Rt is newly set in step S32 or step S33, the time measured by the time measuring means 42 is cleared (re-started) (step S34), and step S14 and the following steps are repeated.

By performing the control as described above, the target rotating speed of the DC motor can be set appropriately based on the change in the duty ratio. As a result, without a need to obtain the detailed change status of the internal temperature and the outside air temperature, the DC motor can be run at an appropriate rotating speed. Therefore, the interior of the refrigerator can be cooled to an appropriate temperature and energy saving can be achieved while suppressing an increase in cost.

Although in the above described example, the degree of the change in the duty ratio is set to two ranges which are a range equal to or greater than X % and a range less than X %, the present invention is not limited to this. For example, the degree of the change in the duty ratio may be set to three or more ranges. The newly set values of the target rotating speed Rt may be determined so as to correspond to the ranges, respectively. The method of newly setting the value of the target rotating speed Rt is not particularly limited. For example, like the above stated second target rotating speed Rt2, the value of the newly set target rotating speed may be set without changing it (2,400 rpm), or otherwise only a value (800 rpm) of an increase in the target rotating speed may be set. Or, a rate (150%) of the target rotating speed Rt before and after the target rotating speed Rt is newly set, or a rate (50%) of the value of the increase with respect to the value before newly set, may be set.

Or, regarding a temperature sensing section and a switch section of the thermostat 104, the temperature sensing section may be placed in a location where the internal temperature can be detected, while the switch section may be placed on a feeding line from the power supply utility 100 to the control device 1 (especially inverter controller 3). In this configuration, when the internal temperature is lowered adequately and the temperature sensing section detects a temperature lower than the threshold Th, the switch section operates to cut off electric power supply from the power supply utility 100 to the control device 1. Therefore, when the internal temperature is lower than the threshold Th, the electric power is not supplied to the control device 1 and thus energy saving can be achieved during a standby state.

Embodiment 3

A control device 1 of Embodiment 3 performs control in such a manner that it obtains a duty ratio at a present time point when the DC motor 103 is being run at a constant rotating speed, and increases the target rotating speed Rt after a passage of time set based on the duty ratio. The control device 1 obtains a voltage value (hereinafter referred to as a feeding voltage) of electric power input to the inverter circuit 2. Based on the feeding voltage, the control device 1 adjusts a set time (time that passes before the target rotating speed Rt is increased) based on the duty ratio.

In more detail, as described previously, there is a correlation between the cooling load and the duty ratio. That is, in a case where the DC motor 103 is run at a constant rotating speed, the duty ratio increases as the cooling load increases. Therefore, in a case where the duty ratio is great, it can be determined that the cooling load is great. Therefore, the target rotating speed Rt is preferably increased to enhance a cooling capability of a refrigeration cycle.

However, the duty ratio is affected by a magnitude of the feeding voltage as well as the cooling load. For example, it is assumed that in a case where the DC motor 103 is run at a constant rotating speed, the feeding voltage input to the inverter circuit 2 becomes high in a state in which the cooling load is constant. In this case, to maintain the rotating speed of the DC motor 103 at a constant value, it is necessary to maintain the voltage of the driving electric power at a constant value even when the feeding voltage increases. Because of this, the control device 1 decreases the duty ratio. On the other hand, when the feeding voltage input to the inverter circuit 2 becomes low, the control device 1 increases the duty ratio to maintain the voltage of the driving electric power at a constant value.

In a case where the DC motor 103 is run at a constant rotating speed, there is a correlation among the duty ratio, the cooling load and the feeding voltage. In view of the feeding voltage in addition to the duty ratio, the cooling load can be known more accurately.

Accordingly, in a case where the duty ratio is equal to or greater than a predetermined threshold, the control device 1 determines that the cooling load is great, and increases the target rotating speed Rt after a passage of a short time, as a basic operation. Likewise, as a basic operation, in a case where the duty ratio is less than the predetermined threshold, the control device 1 determines that the cooling load is small, and increases the target rotating speed Rt after a passage of a long time. In addition to these basic operations, the control device 1 uses a smaller threshold of the duty ratio when the feeding voltage is high and a greater threshold of the duty ratio when the feeding voltage is low.

This makes it possible to prevent the DC motor 103 from being run at an unnecessarily high rotating speed in the case where the cooling load is small, thereby achieving energy saving. In addition, by considering the feeding voltage in addition to the duty ratio, it becomes possible to know the cooling load more accurately and control the running of the DC motor 103 more appropriately.

Hereinafter, a description will be specifically given of an exemplary configuration and an exemplary operation of the control device 1 which implements such a control method with reference to the drawings.

Figure 5:
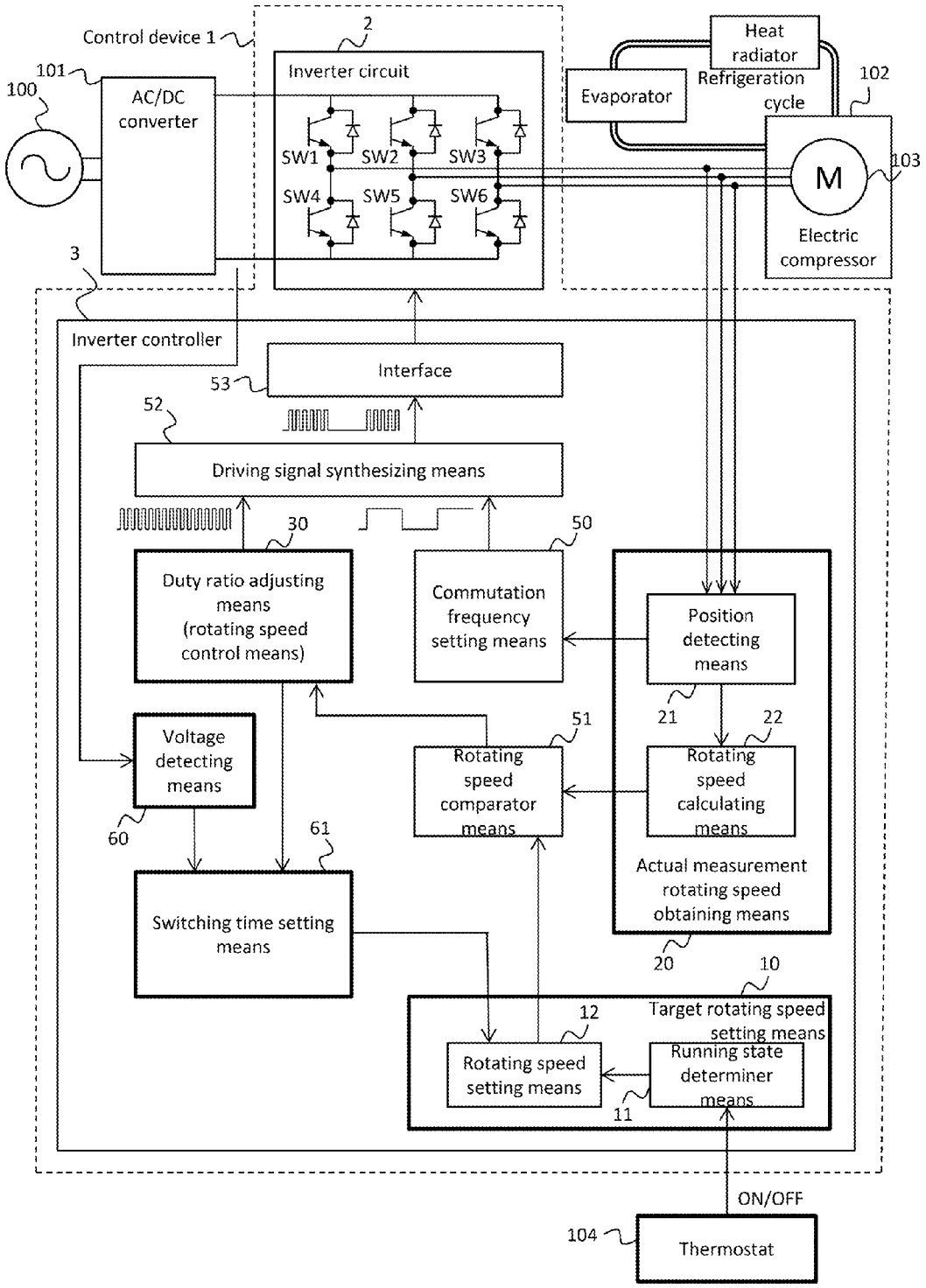
FIG. 5 is a block diagram showing a configuration of a control device in an electric compressor according to Embodiment 3 of the present invention.

FIG. 5 is a block diagram showing a configuration of a control device in an electric compressor according to Embodiment 3 of the present invention. The control device 1 of FIG. 5 has almost the same components as those of the control device 1 (see FIG. 3) of Embodiment 2. However, the control device 1 of FIG. 5 is different from the control device 1 of Embodiment 2 in that it does not include the duty ratio change obtaining means 40 but includes a voltage detecting means 60 and a switching time setting means 61. Alternatively, the control device 1 of Embodiment 2 including the duty ratio change obtaining means 40 may further include the voltage detecting means 60 and the switching time setting means 61.

The voltage detecting means 60 detects a feeding voltage (DC voltage) output from the AC/DC converter 101 and input to the inverter circuit 2, and outputs the feeding voltage to the switching time setting means 61. The switching time setting means 61 obtains a duty ratio in a state in which the DC motor 103 is run at a specified constant rotating speed from the duty ratio adjusting means 30, compares the duty ratio to the threshold according to the input feeding voltage, and sets time that passes before the target rotating speed Rt is increased. In addition to setting of the time, measuring of the time is performed. In FIG. 5, the same components of the control device 1 as those of the control devices 1 of Embodiment 1 and Embodiment 2, as described above, are designated by the same reference symbols and will not be described in detail.

[Control Method]

Figure 6:
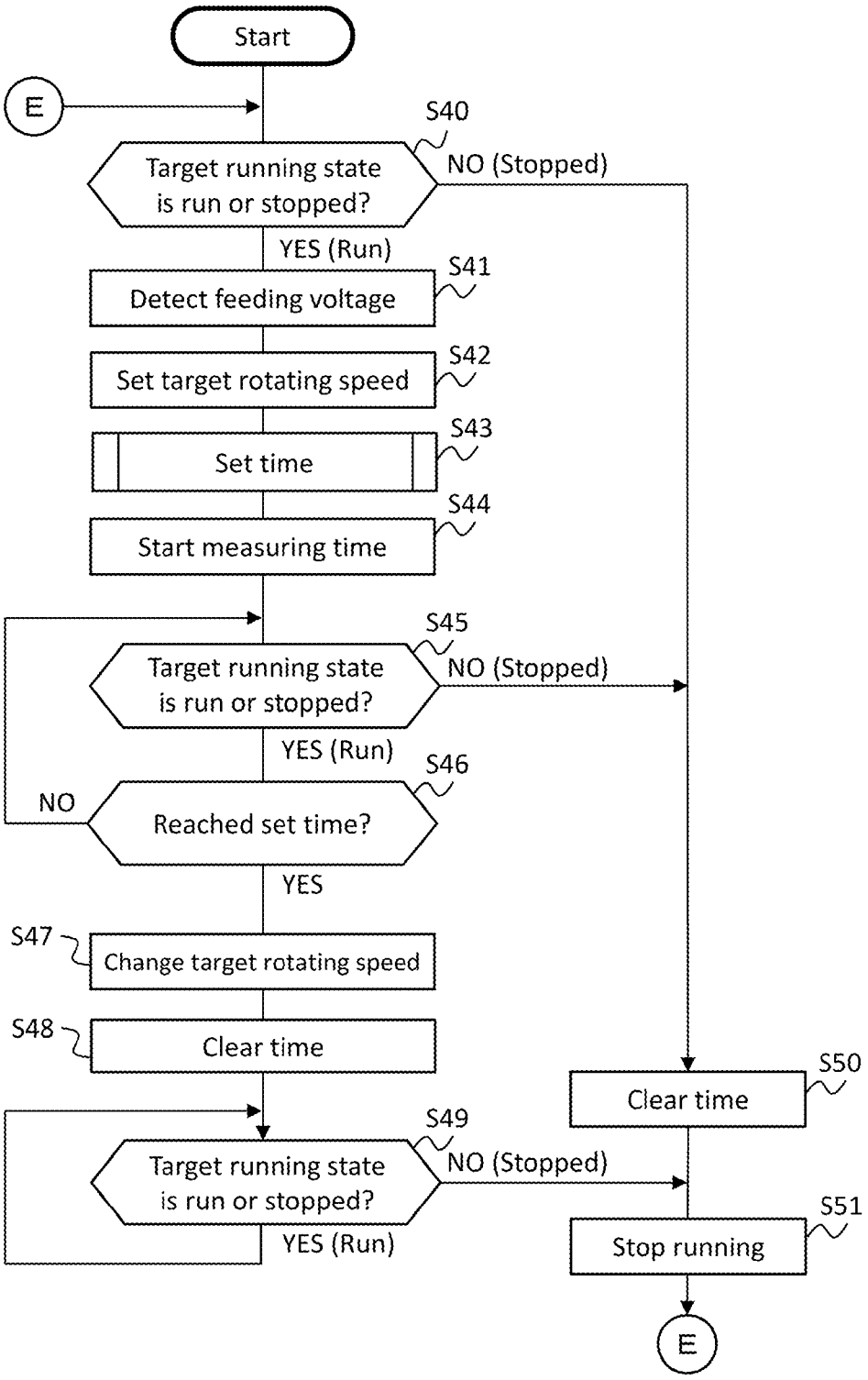
FIG. 6 is a flowchart showing an operation procedure of the control device according to Embodiment 3.
Figure 7:
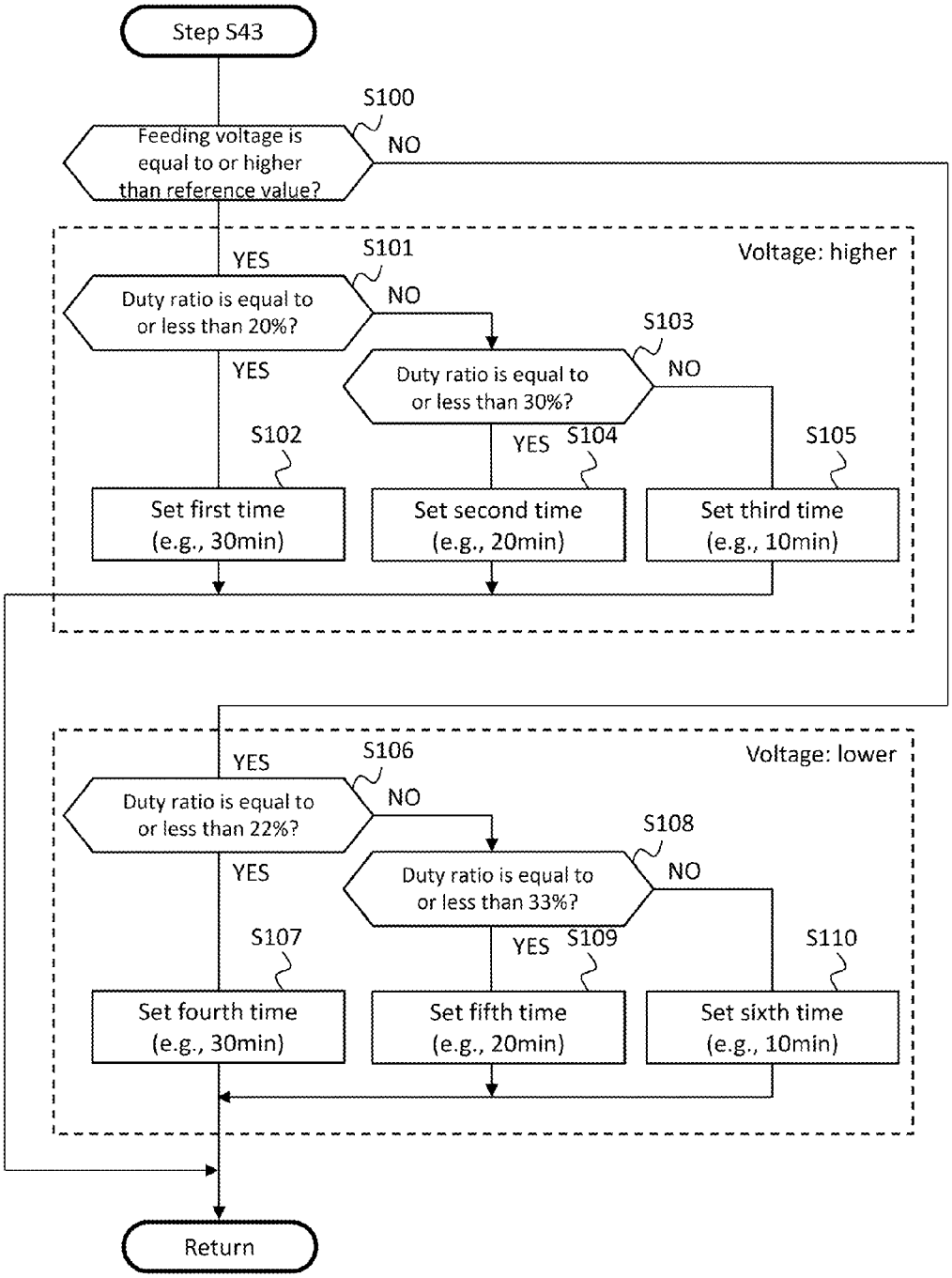
FIG. 7 is a flowchart showing a content of a time setting process in the operation procedure of the control device.

Next, a description will be given of a control method of the electric compressor 102 which is implemented by the above stated controller. FIG. 6 is a flowchart showing an operation procedure of the control device according to Embodiment 3. FIG. 7 is a flowchart showing a content of a time setting process in the operation procedure of the control device.

As shown in FIG. 6, the control device 1 determines whether the target running state of the electric compressor 102 is "the electric compressor 102 should be run" or "the electric compressor 102 should be stopped" based on the signal received from the thermostat 104 (step S40). If the control device 1 determines that "the electric compressor 102 should be stopped" (S40: NO), it clears the time measured by the switching time setting means 61 (step S50) and performs predetermined stop processing (step S51).

On the other hand, when the control device 1 determines that "the electric compressor 102 should be run" (S40: YES), it detects a feeding voltage when the electric compressor 102 has gone through the start-up mode and reached a specified stable running state (step S41). Also, the target rotating speed setting means 10 sets the target rotating speed Rt (step S42). As the target rotating speed Rt, a minimum rotating speed with which the electric compressor 102 can operate stably, a rotating speed which results in a high efficiency, or the like, can be preset.

Then, a process for setting time that passes before the target rotating speed Rt is increased is performed (step S43). In this time setting process, the time is set using the feeding voltage obtained in step S41 and the duty ratio obtained from the duty ratio adjusting means 30. Hereinafter, a specific exemplary operation will be described with reference to FIG. 7.

As shown in FIG. 7, initially, the control device 1 determines whether or not the feeding voltage is equal to or higher than a reference value (step S100). The reference value may be, for example, 260V. Typically, the AC/DC converter 101 is configured to use a voltage doubler rectifier method in a case where an effective value of the AC voltage of the power supply utility 100 is 100V. Therefore, the feeding voltage in a normal state is about 282V. Or, the AC/DC converter 101 is configured to use a total voltage rectifier method in a case where the effective value of the AC voltage of the power supply utility 100 is 200V. Therefore, the feeding voltage in a normal state is also about 282V. Therefore, a value which is a little lower than the feeding voltage in a normal state can be set as a determination reference value in step S100.

If the control device 1 determines that the feeding voltage is equal to or higher than the reference value (S100: YES), it sets time based on a threshold (e.g., 20%, 30%) preset as corresponding to a case where the feeding voltage is high (step S101 to step S105). In other words, the control device 1 determines whether or not a duty ratio at a present time point which is obtained from the duty ratio adjusting means 30 is equal to or less than 20% (first threshold) (step S101). If the control device 1 determines that the duty ratio is equal to or less than 20% (S101: YES), it sets first time (e.g., 30 minutes) corresponding to a low load in a high-voltage state, as the time that passes before the target rotating speed Rt is increased (step S102). If the control device 1 determines that the duty ratio is greater than 20% (S101: NO), the control device 1 determines whether or not the duty ratio is equal to or less than 30% (second threshold) (step S103). If the control device 1 determines that the duty ratio is equal to or less than 30% (step S103: YES), it sets second time (e.g., 20 minutes) corresponding to a medium load in a high-voltage state, as the time that passes before the target rotating speed Rt is increased (step S104). If the control device 1 determines that the duty ratio is greater than 30% (step S103: NO), it sets third time (e.g., 10 minutes) corresponding to a high load in a high-voltage state, as the time that passes before the target rotating speed Rt is increased (step S105).

On the other hand, if the control device 1 determines that the feeding voltage is lower than the reference value (S100: NO), it sets time based on a threshold (e.g., 22%, 33%) preset as corresponding to a case where the feeding voltage is low (step S106 to step S110). In other words, the control device 1 determines whether or not a duty ratio at a present time point which is obtained from the duty ratio adjusting means 30 is equal to or less than 22% (third threshold) (step S106). If the control device 1 determines that the duty ratio is equal to or less than 22% (step S106: YES), it sets fourth time (e.g., 30 minutes) corresponding to a low load in a low-voltage state, as the time that passes before the target rotating speed Rt is increased (step S107). If the control device 1 determines that the duty ratio is greater than 22% (step S106: NO), the control device 1 determines whether or not the duty ratio is equal to or less than 33% (fourth threshold) (step S108). If the control device 1 determines that the duty ratio is equal to or less than 33% (step S108: YES), it sets fifth time (e.g., 20 minutes) corresponding to a medium load in a low-voltage state, as the time that passes before the target rotating speed Rt is increased (step S109). If the control device 1 determines that the duty ratio is greater than 33% (step S108: NO), it sets sixth time (e.g., 10 minutes) corresponding to a high load in a low-voltage state, as the time that passes before the target rotating speed Rt is increased (step S110).

In the above description, the first to fourth thresholds associated with the duty ratio are set to satisfy a relationship in which first threshold<third threshold and second threshold<fourth threshold. This is because the duty ratio is different due to a difference in feeding voltage even when the cooling load is the same. The time that passes before the target rotating speed Rt is increased is set to satisfy a relationship in which first time>second time>third time, and fourth time>fifth time>sixth time. This is because the duty ratio is different according to the cooling load even when the feeding voltage is constant. The above thresholds of the duty ratio can be suitably set according to a specification of the DC motor 103 and a specification of the refrigerator.

By performing the control as described above, the cooling load can be known more appropriately based on the duty ratio and the feeding voltage. As a result, the electric compressor 102 can be run with a high efficiency and thus energy saving can be achieved. In this case, the control can be implemented by using a thermostat, or the like which is relatively inexpensive, without a need for an expensive sensor or the like.

In a case where Embodiment 1 or Embodiment 2 is combined with Embodiment 3, either one of the control method of Embodiment 1 or Embodiment 2, and the control method of Embodiment 3 can be selectively performed. Or, the control method of Embodiment 1 or Embodiment 2, may be effectively combined with the control method of Embodiment 3, and the resulting control method may be performed. For example, firstly, in accordance with the control method of Embodiment 3, the time that passes before the target rotating speed Rt is increased is set (S43). Then, measuring of time starts (S44, S13). When the set time passes (S46: YES, S15: YES), the target rotating speed Rt is increased (newly set) (S47). It should be noted that the target rotating speed Rt to be newly set in this case is decided in accordance with the control method of Embodiment 1 or Embodiment 2 (S30 to S33). By employing such a control method, even in a configuration which is less in sensors and the like and is low in cost, it becomes possible to implement a control device which is able to perform cooling appropriately and achieve energy saving.

INDUSTRIAL APPLICABILITY

The present invention is applicable to a control method of an electric compressor which is able to appropriately cool an interior of a refrigerator and achieve energy saving, while suppressing an increase in cost.

REFERENCE SIGNS LIST

1 control device
2 inverter circuit
3 inverter controller

10 target rotating speed setting means
20 actual measurement rotating speed obtaining means
30 duty ratio adjusting means
40 duty ratio change obtaining means
100 power supply utility
101 AC/DC converter
102 electric compressor
103 DC motor
104 thermostat

The invention claimed is:

1. A control device of an electric compressor comprising:

an inverter circuit for outputting driving electric power to a DC motor of an electric compressor included in a refrigeration cycle; and an inverter controller for outputting a driving signal of the inverter circuit wherein the inverter controller includes:

a target rotating speed setting means which sets a specified constant rotating speed as a target rotating speed of the DC motor;

an actual measurement rotating speed obtaining means which obtains an actual measurement rotating speed which is a measurement value of a rotating speed of the DC motor, with a passage of time;

a duty ratio adjusting means which adjusts a duty ratio of the driving electric power output from the inverter circuit so that the actual measurement rotating speed matches the target rotating speed; and a duty ratio change obtaining means which obtains a change in the duty ratio which occurs with a passage of time;

wherein the target rotating speed setting means is configured to update the target rotating speed of the DC motor, based on the change in the duty ratio which occurs with a passage of time, wherein the duty ratio change obtaining means obtains a difference value between duty ratios set at different timings by the duty ratio adjusting means;

wherein the target rotating speed setting means increases the target rotating speed based on the difference value between the duty ratios which is obtained by the duty ratio change obtaining means, and wherein the duty ratio change obtaining means includes:

a duty ratio storage means which stores a first duty ratio obtained from the duty ratio adjusting means at a first timing;

a time measuring means which measures time that passes from the first timing; and a duty ratio comparator means which compares a second duty ratio obtained from the duty ratio adjusting means at a second timing which is a specified time after the first timing, to the first duty ratio stored in the duty ratio storage means.

2. The control device of the electric compressor according to claim 1, wherein the inverter controller further includes:

a commutation frequency setting means which sets a commutation frequency of the driving electric power based on the actual measurement rotating speed; and a driving signal synthesizing means which synthesizes the duty ratio set by the duty ratio adjusting means and the commutation frequency set by the commutation frequency setting means, to generate the driving signals.

3. The control device of the electric compressor according to claim 1, wherein the inverter controller further includes:

a switching time setting means which sets time that passes before the target rotating speed is updated, based on the duty ratio and a voltage input to the inverter circuit.

4. A refrigerator comprising:

the control device as recited in claim 1; and further comprising the electric compressor and the DC motor included in the refrigeration cycle.

5. The refrigerator according to claim 4, further comprising:

a thermostat which outputs a signal used to determine whether or not an internal temperature of the refrigerator is equal to or higher than a specified temperature;

wherein the control device updates the target rotating speed of the DC motor, based on a change in the duty ratio of the driving electric power, which occurs with a passage of time, when the internal temperature is equal to or higher than the specified temperature.

* * * * *